US007819338B1

(12) United States Patent
Goettl

(10) Patent No.: US 7,819,338 B1
(45) Date of Patent: Oct. 26, 2010

(54) CAM OPERATED SWIMMING POOL CLEANING NOZZLE

(75) Inventor: John M. Goettl, Phoenix, AZ (US)

(73) Assignee: Paramount Pool & Spa Systems, Chandler, AZ (US)

( * ) Notice: Subject to any disclaimer, the term of this patent is extended or adjusted under 35 U.S.C. 154(b) by 275 days.

(21) Appl. No.: 12/100,135

(22) Filed: Apr. 9, 2008

(51) Int. Cl.
*B05B 15/10* (2006.01)
*E04H 4/16* (2006.01)
*E04H 4/14* (2006.01)

(52) U.S. Cl. ..... 239/205; 239/204; 4/490

(58) Field of Classification Search ..... 239/200–205, 239/208, 282; 4/490, 492
See application file for complete search history.

(56) References Cited

U.S. PATENT DOCUMENTS

| | | | | |
|---|---|---|---|---|
| 1,821,579 | A | 9/1931 | Rader | |
| 1,964,269 | A | 6/1934 | Munz | |
| 2,209,961 | A | 8/1940 | De Lacy-Mulhall | |
| 2,214,852 | A | 9/1940 | De Lacy-Mulhall | |
| 3,237,866 | A | 3/1966 | Lovell | |
| 3,247,968 | A | 4/1966 | Miller | |
| 3,247,969 | A | 4/1966 | Miller | |
| 3,408,006 | A | 10/1968 | Stanwood | |
| 3,449,772 | A | 6/1969 | Werner | |
| 3,486,623 | A | 12/1969 | Bosico | |
| 3,506,489 | A | 4/1970 | Baker | |
| 3,515,351 | A | 6/1970 | Costa | |
| 3,521,304 | A | 7/1970 | Ghiz | |
| 3,675,252 | A | 7/1972 | Ghiz | |
| 3,765,608 | A | 10/1973 | Lockwood | |
| 3,955,764 | A | 5/1976 | Phaup | |
| 4,114,206 | A | 9/1978 | Franc | |
| 4,188,673 | A | 2/1980 | Carter | |
| 4,193,870 | A | 3/1980 | Goodin | |
| 4,195,371 | A | 4/1980 | Goodin | |
| 4,200,230 | A | 4/1980 | Gould | |
| 4,202,499 | A | 5/1980 | Mathews | |
| 4,212,088 | A | 7/1980 | Goettl et al. | |
| 4,271,541 | A | 6/1981 | Mathews | |
| 4,276,163 | A | 6/1981 | Gordon | |
| 4,322,860 | A | 4/1982 | Gould | |
| 4,347,979 | A | 9/1982 | Mathews | |
| 4,371,994 | A | 2/1983 | Mathews | |
| 4,391,005 | A | 7/1983 | Goettl | |
| 4,462,546 | A | 7/1984 | Pitman | |
| 4,466,142 | A | 8/1984 | Gould | |
| 4,471,908 | A | 9/1984 | Hunter | |
| 4,520,514 | A | 6/1985 | Johnson | |
| 4,568,024 | A | 2/1986 | Hunter | |
| 4,592,379 | A | 6/1986 | Goettl | |
| 4,939,797 | A | 7/1990 | Goettl | |
| 5,048,758 | A * | 9/1991 | Jackerson | 239/239 |
| 5,135,579 | A | 8/1992 | Goettl | |
| 5,251,343 | A | 10/1993 | Goettl | |

(Continued)

*Primary Examiner*—Darren W Gorman
(74) *Attorney, Agent, or Firm*—Booth Udall, PLC

(57) ABSTRACT

A swimming pool cleaning head. Implementations may include a cleaning head assembly having a housing having a cam assembly with an upper section, a lower section, and a rotatable section disposed between the upper section and the lower section. A stem having an outlet configured to eject a stream of water under water therethrough under water pressure force may also be included, the stem extending through the cam assembly. The stem may also include at least one pin slidably engaged within the cam assembly.

14 Claims, 6 Drawing Sheets

U.S. PATENT DOCUMENTS

| | | | | |
|---|---|---|---|---|
| 5,333,788 | A | 8/1994 | Hadar | |
| 5,826,797 | A | 10/1998 | Kah, III | |
| 6,029,907 | A | 2/2000 | McKenzie | |
| 6,085,995 | A | 7/2000 | Kah, Jr. et al. | |
| 6,182,909 | B1 | 2/2001 | Kah, Jr. et al. | |
| 6,237,862 | B1 | 5/2001 | Kah, III et al. | |
| 6,301,723 | B1 | 10/2001 | Goettl | |
| 6,367,098 | B1 | 4/2002 | Barnes | |
| 6,393,629 | B1 | 5/2002 | Barnes et al. | |
| 6,438,766 | B1 | 8/2002 | Arnau et al. | |
| 6,971,588 | B1 * | 12/2005 | Tarr et al. | 239/204 |
| 7,708,212 | B1 * | 5/2010 | Conn | 239/600 |
| 2004/0194201 | A1 * | 10/2004 | Goettl | 4/491 |
| 2004/0217210 | A1 * | 11/2004 | Goettl et al. | 239/548 |

* cited by examiner

CAM OPERATED SWIMMING POOL CLEANING NOZZLE

BACKGROUND

1. Technical Field

Aspects of this document relate generally to cleaning nozzles for swimming pools.

2. Background Art

Conventional cleaning nozzles for swimming pools utilize water pressure generated by a pool pump to direct a stream of water across a surface of the pool to entrain and move contaminants from the surface toward a drain. Many conventional cleaning nozzles "pop up" from a surface of a pool as the heads, normally level with the surface, are extended under the influence of water pressure from the pump. When the water pressure from the pump ends, the heads retract downward until level with the surface, conventionally in response to bias from a spring element contained within the cleaning nozzle.

Conventional cleaning heads typically couple with floor mountings either through a threaded mounting or through a lug mounting. In each of these conventional approaches, the final positioning of the directional spray nozzle is determined by the initial installation of the mounting component. For example, for a threaded coupling, it is unknown where the directional spray nozzle will be pointing when the cleaning head is threadedly coupled with the wall or floor mounting until it is actually threaded tight. For lug mountings, such as that disclosed in U.S. Pat. No. 6,848,124 to Goettl, the disclosure of which is hereby incorporated herein by reference, although one can make a more educated guess than with threaded mountings, in practice the position is still unknown and can be far from a desired location. With conventional 360 degree rotation cleaning heads, the fact that the positional direction is not adjustable is of no consequence. However, with directionally rotational heads such as those disclosed herein, the angular position of the directional spray nozzle is of consequence.

SUMMARY

A first implementation of a swimming pool cleaning head includes a cleaning head assembly comprising a cam assembly with a plurality of saw tooth members. A stem extends through the cam assembly, the stem having a pin slidably engaged with the plurality of saw tooth members. The pin may be configured to incrementally rotate the stem clockwise through the saw tooth members during vertical translation of the stem through water pressure force. The cam assembly may be configured to automatically reverse the incremental rotation of the stem to counterclockwise.

First implementations of a swimming pool cleaning head may include one, all, or some of the following:

The cam assembly may include an upper section, a lower section, and a rotatable section slidably disposed between the upper section and the lower section.

The cleaning head assembly may include a housing and the stem may include a locking ring having a plurality of lugs configured to engage with the house and also configured to substantially prevent rotational movement of the upper section and lower section of the cam assembly.

A second implementation of a swimming pool cleaning head includes a cleaning head assembly having a housing with a cam assembly and a stem. The stem extends through the cam assembly and includes at least one pin slidably engaged within the cam assembly. The cam assembly may be configured to both incrementally rotate the stem clockwise through the pin as the stem extends from the housing under water pressure force and to automatically reverse the incremental rotation of the stem counterclockwise.

Second implementations of swimming pool cleaning heads may include one, all, or some of the following:

The cam assembly components may be integrally formed.

The cam assembly may include an upper section, a lower section, and a slidable section. The slidable section may be rotationally slidable with respect to the lower section and the upper section.

The cleaning head assembly may include a housing and the stem may include a locking ring having a plurality of lugs configured to engage with the housing and also configured to substantially prevent rotational movement of the upper section and the lower section of the cam assembly.

A third implementation of a swimming pool cleaning head includes a cleaning head assembly having a housing having a cam assembly with an upper section, a lower section, and a rotatable section disposed between the upper section and the lower section. A stem having an outlet configured to eject a stream of water under water therethrough under water pressure force is also included, the stem extending through the cam assembly. The stem may also include at least one pin slidably engaged within the cam assembly.

Third implementations of swimming pool cleaning heads may include one, all, or some of the following.

As a result of the application and removal of water pressure force on the stem, the pin may be configured to intermittently engage with a saw tooth member of the upper section and slidable section and to slidably rotate the slidable section while the stem is under water pressure or spring bias force.

The saw tooth members of the slidable section may form a channel in communication with an angled channel in the upper or lower sections. The slidable section may also be configured to accommodate through slidable rotation, the pin, as it enters the channel.

The cleaning head assembly may also include a housing. The stem may also include a locking ring having a plurality of lugs configured to engage with the housing and also configured to substantially prevent rotational movement of the upper section and the lower section of the cam assembly.

First, second, and third implementations may individually, collectively, or in combination utilize implementations of a method of adjusting a swimming pool cleaning head. The method includes disengaging a locking arm engaged with a cap ring, rotating the cap ring in a first direction, adjusting a cam assembly, rotating the cap ring in a second direction, and engaging the locking arm with the cap ring.

Implementations of a method of adjusting a swimming pool cleaning head may include one, all, or some of the following:

Pressing on the locking arm through an opening in the cap ring.

Rotating the cap ring in a first direction may include disengaging a plurality of ridges on a housing with a plurality of grooves on a lower section of a cam assembly.

Rotating the cap ring in a second direction may include engaging the plurality of ridges on the housing with the plurality of grooves on the lower section of the cam assembly.

Rotating the cap ring in a first direction may include disengaging projections of the cap ring from ramp members of a locking ring.

Rotating the cap ring in a second direction may include engaging projections of the cap ring with ramp members of a locking ring.

Adjusting the cam assembly may include rotatably adjusting the position of the cam assembly.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended cleaning head assembly and/or assembly procedures for a cleaning head assembly will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such nozzle assemblies and implementing components, consistent with the intended operation.

Figure 1:
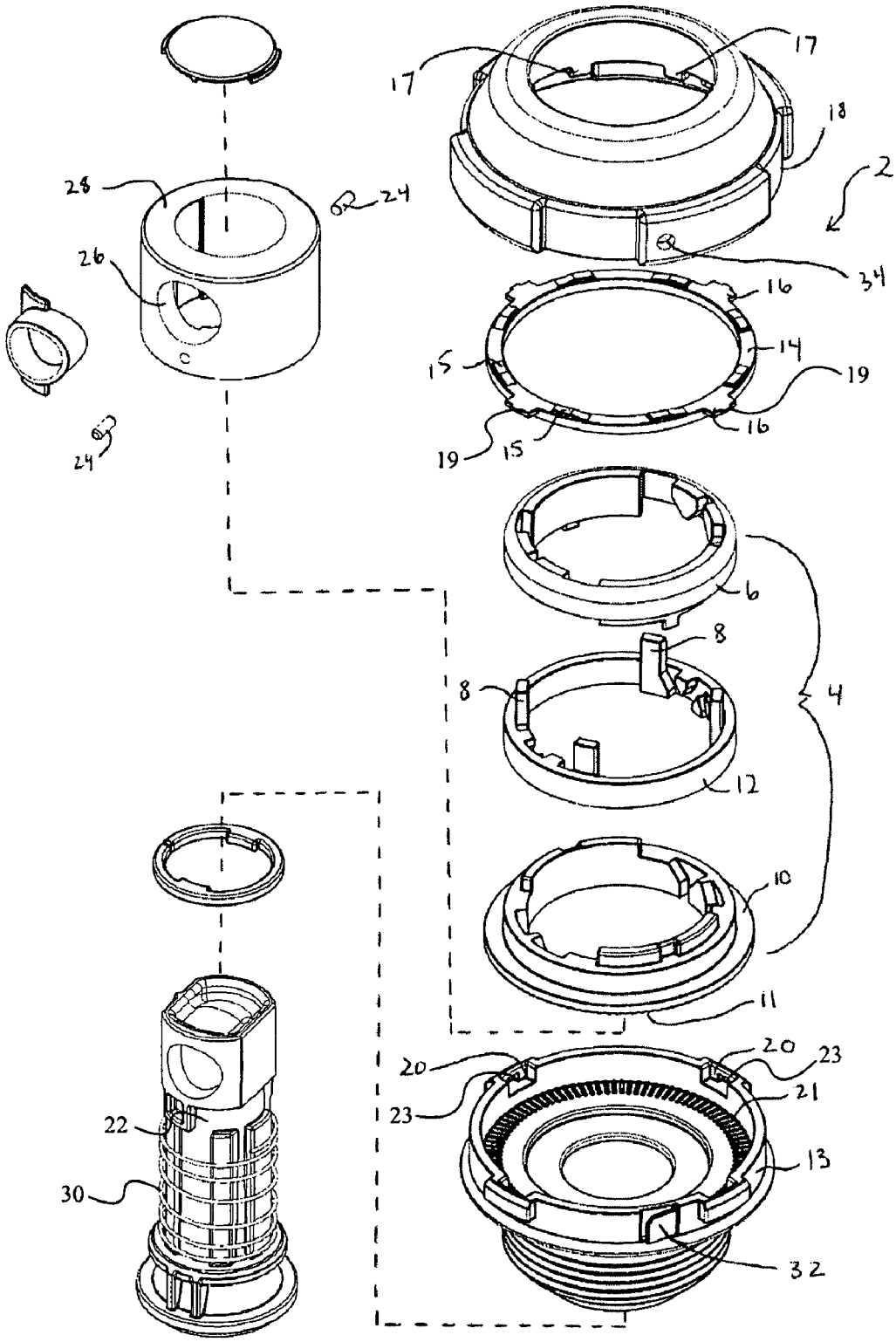
FIG. 1 is an perspective view of an implementation of a cleaning head assembly.

Referring to FIG. 1, an exploded view of an implementation of a cleaning head assembly 2 is illustrated. The cleaning head assembly 2 includes a cam assembly 4. As illustrated, in particular implementations, the cam assembly 4 includes an upper section 6, a slidable section 12, and a lower section 10. The slidable section 12 includes at least one shifter 8 that extends from the slidable section 12 into the upper section 6. The cam assembly 4 couples into a housing 13. When coupled into the housing 13, a locking ring 14 is coupled over the lower section 10 and may include lugs 16 that engage within locking features 20 in the housing 13. In particular implementations, the upper section 6 and lower section 10 of the cam assembly 4 may be fixedly coupled together through, by non-limiting example, a sonic weld, heat staking, adhesive or other method of fixedly coupling two parts together. In other implementations, the upper section 6 and lower section 10 may be integrally formed. While the upper section 6 and lower section 10 are fixedly coupled together, the slidable section 12 remains slidably engaged between them and is free to move rotatably with respect to the upper and lower sections 6, 10, respectively.

The tips of the lugs 16, of the particular implementation shown in FIG. 1, are configured with prongs 19 that fit into the recesses 23 of the locking features 20 in the housing 13. Placement of the locking ring 14 over the cam assembly 4 in the lower section 10 holds the cam assembly 4 in place through mating of the prongs 19 with the recesses 23. In many cases, the strength of the engagement of the prongs 19 into the recesses 23 is strong enough that the up and down nozzle action in the cam assembly 4 so that the nozzle 22 may be tested without the cap ring 18 added. This allows an installer to rotationally adjust the cam assembly 4 in relation to the lower section 10 prior to locking all of the components in place with the cap ring 18. By rotationally adjusting the cam assembly 4 in relation to the lower section 10, the directional orientation of the nozzle 22 may be set regardless of the original orientation of the in-wall fitting for the nozzle assembly. In other words, even though the in-wall fitting for the nozzle assembly yields an unknown radial direction for the final nozzle housing, an installer can adjust the direction of the nozzle during installation to any orientation needed.

The cap ring 18 is coupled over the cam assembly 4 against the locking ring 14. Use of the cap ring 18 may allow, in particular implementations, for the lower and upper sections 6, 10 of the cam assembly 4 to be rendered substantially immobile in relation to the housing 13 during operation of the cleaning head assembly 2, leaving the slidable section 12 capable of rotational sliding motion. The cap ring 18 may be loosened or removed by pressing a locking arm 32 coupled to the housing 13 which is engaged with the cap ring 18 inwardly through an opening 34 in the cap ring 18 until the locking arm 32 disengages from the cap ring 18. The locking arm 32 is biased to a position that engages the cap ring 18. For example, the locking arm 32 may be formed of a flexible material that self-biases the locking arm 32. As another example, the locking arm 32 may be formed as a lever with a spring, or through other structures known in the art for manufacturing a biased arm.

As illustrated in FIG. 1, the ability of the cap ring 18 to render the lower and upper sections 6, 10 of the cam assembly 4 substantially immobile is aided, in particular implementations, by a plurality of ridges 21 distributed along the surface of the housing 13 that couple with the lower section 10 of the cam assembly 4. As illustrated, the lower section 10 includes a plurality of grooves 11 that couple with the plurality of ridges 21 of the housing 13 under compressive force created by the rotation of the cap ring 18. In particular implementations, the compressive force generated by the rotation of the cap ring 18 may be increased through a plurality of ramp members 15 extending from the locking ring 14 that engage with projections 17 of the cap ring 18 while it is rotated. As the cap ring 18 is rotated, the force on the locking ring 14 increases as the projections 17 engage with the ramp members 15, pressing the locking ring 14 against the lower section 10 of the cam assembly 4. As the force against the lower section 10 increases, the plurality of grooves 11 begin to increasingly engage with the plurality of ridges 21, thereby increasingly restricting the rotational motion of the lower section 10 until it is rendered substantially immobile. In particular implementations, once the cap ring 18 has been rotated sufficiently to render the lower section 10 immobile, the locking arm 32 may engage with the cap ring 18 to prevent any unintentional loosening of the cleaning head assembly 2 thereby maintaining the positional relationship between the cam assembly 4 and the housing 13.

As illustrated in FIG. 1, implementations of a cleaning head assembly 2 include a stem 22 that extends through the housing 13 and the cam assembly 4. In the particular implementation illustrated in FIG. 1, the stem 22 comprises at least one pin 24 that extends from a side of a head 28 that couples over the top of the stem 22. In other implementations, the at least one pin 24 couples to other components associated with the stem 22 so that in either case (whether extending from the side of the head 28 or from some other component associated with the stem 22 or from the stem 22 directly), the at least one pin 24 can be said to extend from the stem 22. In particular implementations of a stem 22, two or more pins 24 may be included, and the relation between the direction the pin 24 extends from the side of the stem 22 relative to an outlet 26 may range from about parallel to about perpendicular, depending upon system requirements.

Figure 2:
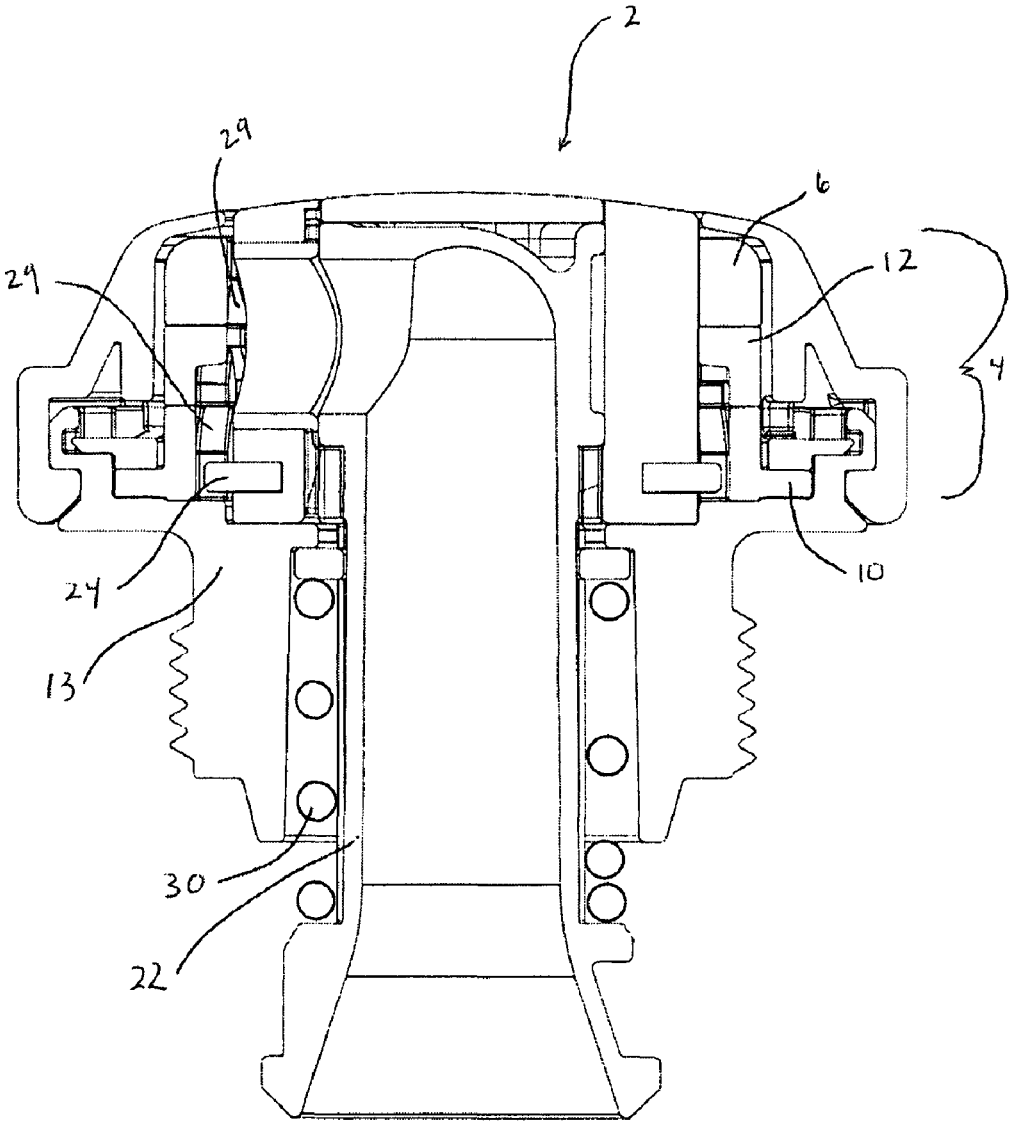
FIG. 2 is a cross sectional view of an implementation of a cleaning head assembly illustrated in a retracted position.
Figure 3:
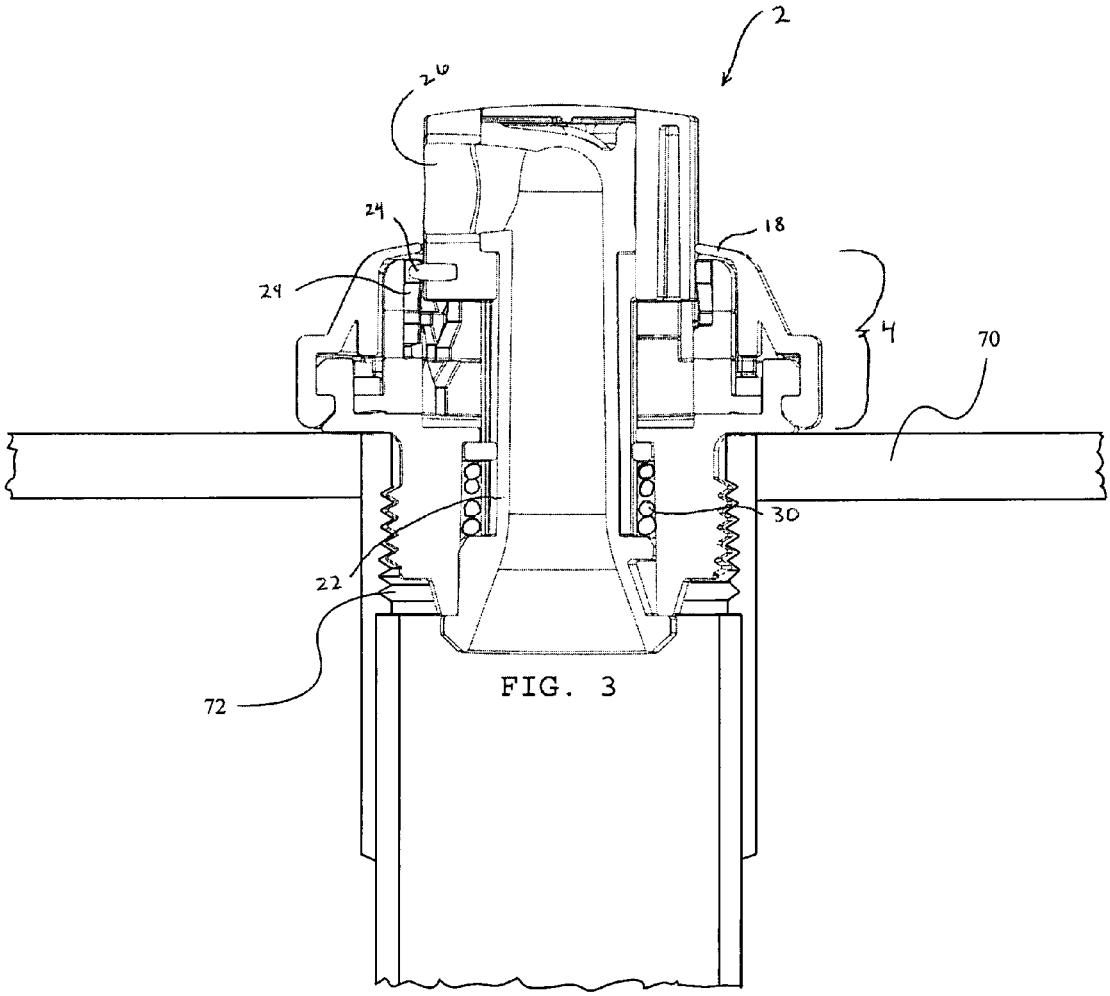
FIG. 3 is a cross sectional view of an implementation of a cleaning head assembly shown in an extended position and installed in a pool wall connected to a typical pool plumbing system.

Referring to FIG. 2, the pin 24 for implementations of a cleaning head assembly 2 engages with the cam assembly 4 within the upper section 6, the slidable section 12, and the lower section 10, as illustrated in FIG. 2. In particular implementations, the pin 24 is engaged against the edges of a plurality of saw teeth 29 within the cam assembly 4. The stem 22 may further include a spring element 30 configured to provide bias force against the stem 22 when it is extended from the housing 13. FIG. 3 illustrates the cleaning head assembly 2 in an extended position, where the outlet 26 is raised above an upper surface of the cap ring 18 and the pin 24 is engaged against a surface of the saw teeth 29 in the upper section 6 of the cam assembly 4. In the extended position, the stem 22 is raised by water pressure force against the bias of the spring element 30. FIG. 3 also illustrates a swimming pool wall 70 with a threaded fitting 72 mounted in the wall. The cleaning head assembly 2 threadedly mates with the threaded fitting 72 in this implementation. Other coupling types are known four coupling a cleaning head assembly to a wall fitting and may equivalently be used in place of the threaded fitting shown here.

Figure 4:
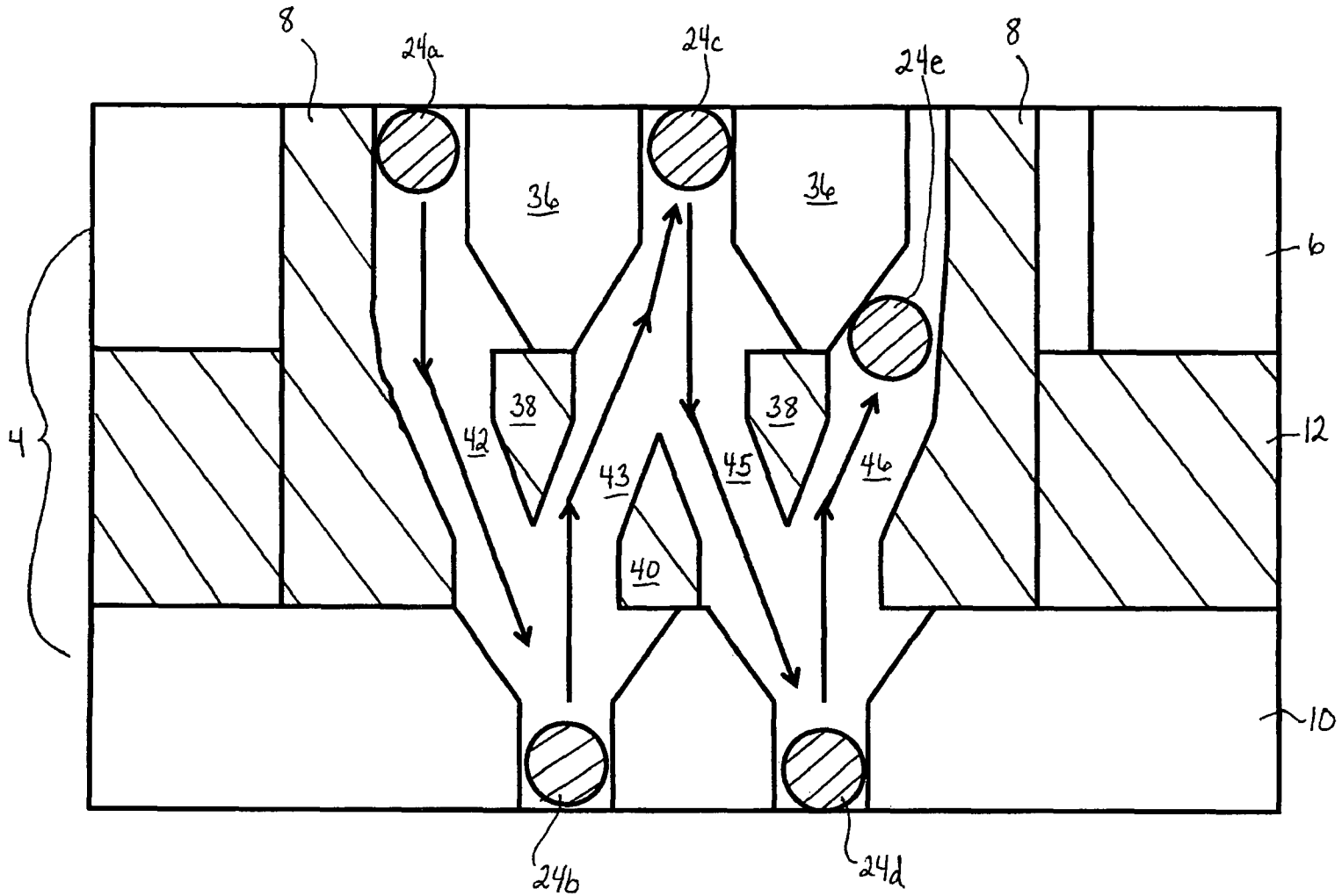
FIG. 4 illustrates the travel path of a pin through the cam assembly of an implementation of a cleaning head assembly during incremental rotation clockwise.

Referring to FIG. 4, an illustration of the interior of a cam assembly for a cleaning head assembly is shown with reference to the particular implementation of FIG. 1 as an example. As illustrated, the edges of the saw teeth 36, 38, 40 of the upper section 6 and slidable section 12 of the cam assembly 10 form a plurality of channels 42, 43, 45, 46 in which a pin 24 travels during operation of a cleaning head assembly 2. For ease of understanding, slidable section 12 has been marked in FIGS. 4 and 5 with right downwardly sloping hatch marks. The pin 24 has been marked with right upwardly sloping hatch marks. Although the Figures show more than one pin 24*a*, 24*b*, 24*c*, 24*d*, 24*e* and 24*f*, this is intended to be illustrative of the movement of the pin 24 from one end of a channel to another end and not necessarily that there are multiple pins 24 in the particular implementation.

During operation of the cleaning head assembly 2, water pressure force is intermittently exerted on the stem 22, forcing it to extend upwardly. For representative purposes, the operation will be described with reference to FIG. 4 beginning while water pressure is being exerted on the stem 22 (i.e. the cleaning head is its extended position (see FIG. 3)), after the shifter 8 has moved to open the channel 42 between the upper cam section 6 tooth 36 and the shifter 8. It should be understood that in its ordinary rest position, the pin 24 would not be in the upper position (as 24*a*) between tooth 36 of the upper cam 6 and the shifter 8, but would be resting within the lower cam section 10. When the water pressure force is removed, the bias of the spring element 30 withdraws the stem 22 into the housing 13 (see FIG. 2).

As the stem 22 withdraws, the pin 24 travels downwardly through the first channel 42 (as indicated by the arrows to position at the bottom of the channel as pin 24*b*). In the process, the rotational position of the stem 22 travels incrementally clockwise (or counterclockwise depending upon the direction of movement for the stem 22). When the intermittent water pressure force is once again exerted on the stem 22, the pin 24 travels upwardly (from 24*b* to 24*c* following the arrows) between the saw teeth 38 and 40, through channel 43. Once again, the rotational position of the stem 22 continues to move incrementally clockwise (or counterclockwise). As the water pressure force is again removed from the stem 22, the bias of the spring element 30 draws the stem 22 (see FIG. 2) downward again, causing the pin 24 to travel into channel 45 between saw teeth 38 and 40 (from 24*c* to 24*d* following the arrows), further moving the rotational position of the stem 22 incrementally clockwise (or counterclockwise) until it rests in the position illustrated in FIG. 4 as pin 24*d*. It should be noted that when the pin 24*d* initially comes to rest in the position illustrated in FIG. 4, the slidable section 12 (and integral shifter 8) is still in its position to the left illustrated in FIG. 4.

Figure 5:
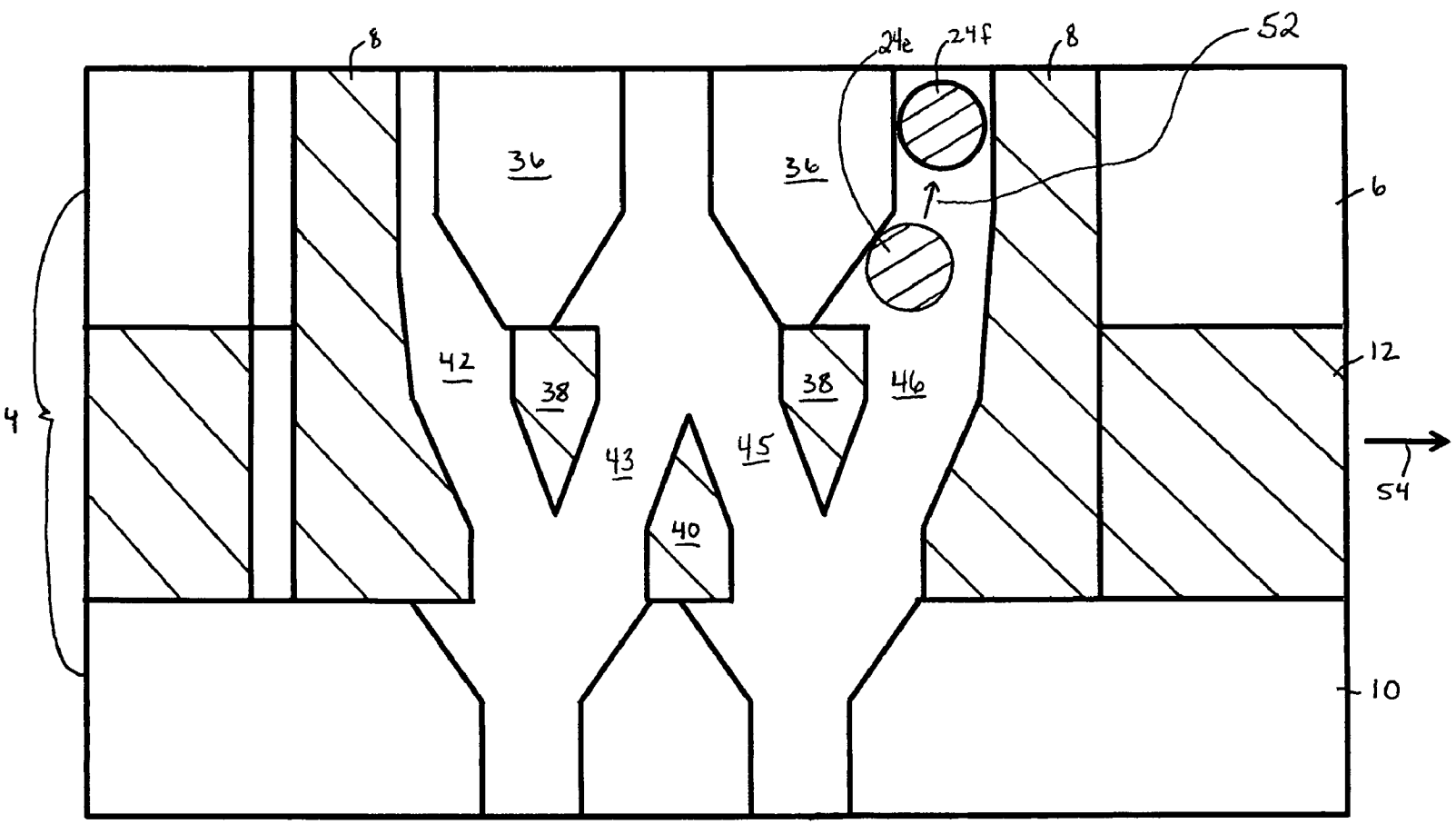
FIG. 5 illustrates the travel path of a pin through the cam assembly of an implementation of a cleaning head assembly indicating the movement of the slidable section followed by incremental rotation counterclockwise.

By repeating the intermittent application and removal of water pressure force, stem 22 continues to rotate through the cam configuration dictated by the position of the slidable section 12 and integral shifter 8 (FIG. 4 in a first slidable section position and FIG. 5 illustrating a second slidable section position) for as many channels the cam assembly includes until it reaches the limits of the cam rotation. For the implementation shown in FIGS. 4 and 5, the implementation includes only four channels 42, 43, 45 and 46.

After the pin 24*d* is positioned at the start of the final channel 46, with the shifter 8 in its position illustrated in FIG. 4, water pressure force is exerted on the stem 22 and the pin 24 enters the final channel 46 as indicated by the arrows. When the pin 24 reaches its position as pin 24*e* in FIG. 4, the interference of the pin 24*e* with the shifter 8 to its right pushes the shifter 8 (and integral slidable section 12) to the right so that the pin 24 can move to its end position as pin 24*f*. The top of channel 46 is originally narrower than the diameter of the pin 24 (see FIG. 4 for its earlier position). In other words, as the pin 24 enters channel 46 under water pressure force as indicated by arrow 52, the pin 24*e* presses against the edge of saw tooth 36 and against the shifter 8, moving the shifter 8 and inducing slidable rotation of the slidable section 12 in relation to the upper and lower cam sections 6 and 10, and a widening of channel 46 to allow the pin 24 to fully enter channel 46. Arrow 54 in FIG. 5 shows the direction of rotation of the slidable section 12 in relation to the remainder of the cam assembly 4.

As channel 46 widens through rotational movement of the shifter 8 coupled to the slidable section 12 of the cam assembly 4, the width of channel 42 is reduced (see FIG. 5 as compared with FIG. 4) and the positions of the teeth 38 and 40 associated with the slidable portion 12 move in relation to the teeth 36 associated with the upper cam section 6 and to the lower cam section 10 (see FIG. 5 as compared with FIG. 4). When the pin 24 reaches channel 46 and completes widening it, the cleaning head assembly 2 (FIG. 1) has reached a first limit position or a predetermined limit after completing a predetermined number of rotational steps and is no longer able to rotate further in the clockwise direction.

When the water pressure force is removed from the stem 22, the pin 24 travels back down channel 46 (from position 24*f* to 24*d*), with the shifter 8 and slidable section 12 in their respective positions shown in FIG. 5. As the pin 24 does so, the angular position of the stem 22 begins to be incrementally and/or automatically adjusted in the counterclockwise direction just like it was previously in the clockwise direction. Under the influence of the intermittent water pressure force, and through the action of the engagement of the pin 24 within the cam assembly 4, the angular position of the stem 22 continues to incrementally travel in the counterclockwise direction until the pin 24 slidably rotates the slidable section 12 back by entering and widening channel 42 at the position of pin 24*a* in FIG. 4, or in other words through reaching a second limit position or predetermined limit. Through automatic positioning and reversal of the pin 24 movement within the predetermined limits of the cam assembly 4, the cleaning head assembly 2 automatically begins another cycle of movement in the clockwise direction after completion of a predetermined number of rotational steps until the intermittent application and release of water pressure in the stem 22 ends. The ability of the slidable section 12 to slidably rotate with respect to the lower and upper sections 10, 6 enables the automatic reversal of the direction of rotation of particular implementations of cleaning head assemblies 2.

While the implementation of a cam assembly 2 illustrated in FIGS. 4 and 5 comprise only a few saw teeth 36, 38, 40, and four channels 42, 43, 45 and 46, in other particular implementations, any number of saw teeth and corresponding channels may be employed. Such implementations may, therefore, incorporate smaller or larger rotational increments (steps), be evenly spaced or unevenly spaced, and/or incorporate a wider or shorter range of rotational movement before automatically reversing direction. For example, the saw teeth 36, 38, 40 may be spaced any distance apart to increase or decrease the stepwise rotational distance the stem 22 turns as water pressure force is intermittently applied. In addition, the degree of rotation of the stem 22 allowed by the number of saw teeth 36, 38, 40 employed may range in particular implementations from something less than 360 degrees to something greater than 0 degrees, depending upon the desired location and function of the cleaning head assembly 2. The rotation range to which particular implementations may be designed is limited only by the space needed for the left and right edges of the shifter 8 and the stops provided on the left and right of the upper and/or lower cam sections 6, 10. It will be understood, however, that the actual dimensions of the stops and edges may vary greatly by the particular materials used to create the cam assembly 2 and the pressures to which the cam assembly is exposed. It is anticipated, however, that in most cases the rotation range needed will be sufficiently below 360 degrees and sufficiently above 0 degrees that the stops and shifter edges widths will not be a concern.

Also, in particular implementations, the relative sizes of the saw teeth 36, 38, 40 and/or angles of the channels 42, 43, 45, and 46 may be varied to allow the stem 22 to rotate a greater angular distance during certain rotational cycles than in others. Implementations employing regularly sized and spaced saw teeth 36, 38, 40 may employ a method of cleaning a pool wall or floor that includes rotating the position of the stem 22 a certain predetermined distance within a predetermined or irregular interval of time. In implementations employing irregularly sized and/or spaced saw teeth 36, 38, 40, the method may employ rotating the position of the stem 22 according to a predefined pattern during a predetermined or irregular interval of time.

Implementations of cleaning head assemblies 2 employing removable and replaceable cam assemblies 4 may also enable adjustment of the overall orientation of the direction of total rotation (whether the rotation of the stem 22 is directed toward or away from a wall, for example) through exchanging of cam assemblies 4. In a conventional cleaning head assembly, the pattern of intermittent spray is fixed and the cam teeth of the cleaning head are built into the cleaning head assembly. Replacement of the cam teeth for a different cam configuration or to replace a broken cam tooth requires replacement of the entire cleaning head assembly. An exchange or a replacement of a cam assembly 4 in particular implementations disclosed herein may be facilitated by decoupling the cap ring 18, removing the locking ring 14, removal of the cam assembly 4 and then replacement of the cam assembly 4 with another cam assembly that is either the same as the first (if repairing), or has different characteristics than the first (such as a degree of total rotation different from the first cam assembly). The locking ring 14 may be reapplied, the cleaning head oriented and its extents tested, and the cap ring 18 reapplied.

This ability to change the overall orientation of the direction of total rotation of the cleaning head assembly 2 also allows for directional adjustment after the cleaning head assembly 2 is installed in a pool floor, step, or sidewall to ensure more optimal routing of contaminants regardless of the initial installation of the cleaning head assembly 2 The foregoing may allow an installer to tune the cleaning area covered by particular implementations of a cleaning head assembly 2 and perform adjustments without requiring specialized tools or lengthy disassembly or replacement.

Figure 6:
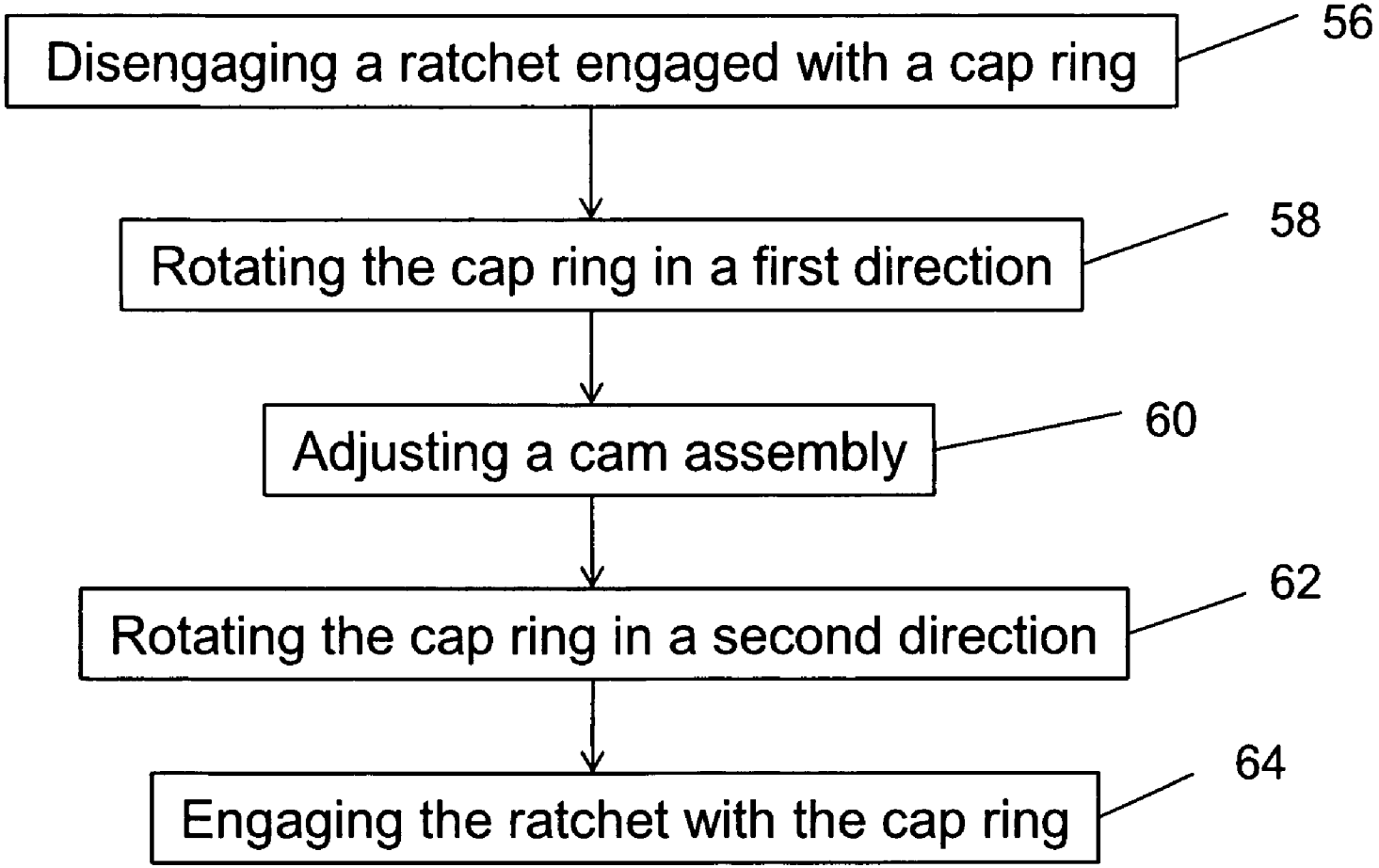
FIG. 6 is a flow diagram of an implementation of a method of adjusting a swimming pool cleaning head.

In addition, implementations of cleaning head assemblies 2 may utilize a method of adjusting the orientation of the cleaning head assembly 2 after the cleaning head assembly 2 has been installed. Referring to FIG. 6, an implementation of the method is illustrated. The method includes the steps of disengaging a locking arm 32 engaged with a cap ring 18 (step 56), rotating the cap ring 18 in a first direction (step 58), adjusting a cam assembly 4 (step 60), rotating the cap ring 18 in a second direction (step 62), and engaging the locking arm 32 with the cap ring 18 (step 64). The method may further include pressing on the locking arm 32 through an opening 34 in the cap ring 18. Rotating the cap ring 18 in a first direction (step 58) may further include disengaging a plurality of ridges 21 on a housing 13 with a plurality of grooves 11 on a lower section 10 of a cam assembly 4 and rotating the cap ring 18 in a second direction (step 62) may further include engaging the plurality of ridges 21 on the housing 13 with a plurality of grooves 11 on a lower section 10 of a cam assembly 4. Rotating the cap ring 18 in a first direction (step 58) may also include disengaging projections 17 of the cap ring 18 from ramp members 15 of a locking ring 14. Rotating the cap ring 18 in a second direction (step 58) may also include engaging projections 17 of the cap ring 18 with ramp members 15 of the locking ring 14. The first direction may be either clockwise or counterclockwise and the second direction will always be in a direction opposite the first direction. Adjusting the cam assembly 4 may include rotatably adjusting the position of the cam assembly 4 so that the path of travel of the stem 22 during automatic cleaning operation covers a desired area of the pool.

It will be understood that implementations are not limited to the specific components disclosed herein, as virtually any components consistent with the intended operation of a method and/or system implementation for a cleaning head assembly may be utilized. Accordingly, for example, although particular nozzle assemblies may be disclosed, such components may comprise any shape, size, style, type, model, version, class, grade, measurement, concentration, material, weight, quantity, and/or the like consistent with the intended operation of a method and/or system implementation for a cleaning head assembly may be used.

In places where the description above refers to particular implementations of nozzle assemblies, it should be readily apparent that a number of modifications may be made without departing from the spirit thereof and that these implementations may be applied to other nozzle assemblies.

The invention claimed is:

1. A swimming pool cleaning head assembly comprising:

a cam housing;

a cam assembly removably coupled to the cam housing, the cam assembly comprising an upper section, a lower section and a rotatable section slidably disposed between the upper section and the lower section and rotatable between a first extent and a second extent, the cam assembly comprising a plurality of saw tooth members;

a locking ring removably coupled to the cam housing over the cam assembly, the locking ring comprising a plurality of lugs configured to engage with the cam housing and substantially prevent rotational movement of the upper section and lower section of the cam assembly;

a stem extending through the cam assembly, the stem comprising a pin slidably engaged with the plurality of saw tooth members, the pin configured to incrementally rotate the stem clockwise through the saw tooth members during vertical translation of the stem through water pressure force and slidably rotate the rotatable section of the cam assembly from its first extent to its second extent; and wherein the cam assembly is configured to automatically reverse the incremental rotation of the stem to counterclockwise.

2. The swimming pool cleaning head assembly of claim 1, wherein the locking ring further comprises an annular surface comprising at least one angled projection extending toward a cap ring rotationally coupled to the cam housing, the cap ring comprising raised projections on an annular surface extending toward the locking ring, wherein rotation of the cap ring in relation to the locking ring causes the raised projections on the cap ring to engage the angled projections on the locking ring to resist rotational movement of the cap ring in one direction.

3. The swimming pool cleaning head assembly of claim 1, further comprising a cap ring removably coupled to the cam housing over the locking ring, the cam housing further comprising a locking arm extending from a side of the cam housing, flexibly engaging the cap ring and resisting rotational movement of the cap ring in one direction.

4. The swimming pool cleaning head assembly of claim 1, further comprising a plurality of ridges on an annular surface of the cam housing, the lower section of the cam assembly comprising a plurality of mating grooves on an annular surface of the lower section of the cam assembly, wherein coupling the plurality of ridges of the cam housing with the plurality of grooves of the cam assembly resists rotational movement of the cam assembly within the cam housing.

5. A swimming pool cleaning head assembly comprising:

a cam housing comprising a cam assembly removably coupled to the cam housing through a locking ring, and a stem extending through the cam assembly, the stem comprising at least one pin slidably engaged with the cam assembly;

a plurality of ridges on an annular surface of the cam housing and a plurality of grooves on an annular surface of the cam assembly that mate with the plurality of ridges on the cam housing when removably coupled thereto and resist rotational movement of the cam assembly within the cam housing; wherein the cam assembly is configured to both incrementally rotate the stem clockwise through the pin as the stem extends from the housing under water pressure force and to automatically reverse the incremental rotation of the stem counterclockwise.

6. The swimming pool cleaning head of claim 5, wherein the cam assembly comprises an upper section, a lower section, and a slidable section, wherein the slidable section is rotationally slidable with respect to the lower section and the upper section.

7. The swimming pool cleaning head assembly of claim 5, further comprising a cap ring removably coupled to the cam housing over the locking ring, the cam housing further comprising a locking arm extending from a side of the cam housing, flexibly engaging the cap ring and preventing rotational movement of the cap ring in one direction.

8. The swimming pool cleaning head assembly of claim 5, wherein the locking ring further comprises an annular surface comprising at least one angled projection extending toward a cap ring rotationally coupled to the cam housing, the cap ring comprising raised projections on an annular surface extending toward the locking ring, wherein rotation of the cap ring in relation to the locking ring causes the raised projections on the cap ring to engage the angled projections on the locking ring to resist rotational movement of the cap ring in one direction.

9. A swimming pool cleaning head comprising:

a cleaning head assembly having a housing comprising a cam assembly having an upper section, a lower section, and a slidable section rotatably disposed between the upper section and the lower section, and a stem comprising an outlet configured to eject an intermittent stream of water under water therethrough under water pressure force, the stem extending through the cam assembly, the stem comprising at least one pin slidably engaged within the cam assembly, the stem comprising a locking ring comprising a plurality of lugs configured to engage with the housing and also configured to substantially prevent rotational movement of the upper section and the lower section of the cam assembly.

10. The swimming pool cleaning head of claim 9, wherein the pin is configured to intermittently engage with a saw tooth member comprised within the upper section and slidable section and to slidably rotate the slidable section while the stem is under water pressure force.

11. The swimming pool cleaning head of claim 9, wherein the slidable section comprises a channel in communication with an angled channel comprised in the upper section, and the slidable section is configured to accommodate through slidable rotation, the pin, as it enters the channel.

12. The swimming pool cleaning head assembly of claim 9, wherein the locking ring further comprises an annular surface comprising at least one angled projection extending toward a cap ring rotationally coupled to the cam housing, the cap ring comprising raised projections on an annular surface extending toward the locking ring, wherein rotation of the cap ring in relation to the locking ring causes the raised projections on the cap ring to engage the angled projections on the locking ring to resist rotational movement of the cap ring in one direction.

13. The swimming pool cleaning head assembly of claim 6, wherein the slidable section comprises a plurality of saw tooth members.

14. The swimming pool cleaning head assembly of claim 9, wherein the slidable section comprises a plurality of saw tooth members.

* * * * *